United States Patent [19]

Fast

[11] Patent Number: 4,546,943

[45] Date of Patent: Oct. 15, 1985

[54] STRIP MERCHANDISER

[76] Inventor: Jacob Fast, 7561 NW. 9th St., Plantation, Fla. 33317

[21] Appl. No.: 596,521

[22] Filed: Apr. 4, 1984

Related U.S. Application Data

[63] Continuation-in-part of Ser. No. 422,009, Sep. 23, 1982.

[51] Int. Cl.[4] ..... A47B 96/06

[52] U.S. Cl. ..... 248/205.3; 40/10 R; 211/57.1; 248/339

[58] Field of Search ..... 248/467, 220.2, 221.3, 248/223.4, 224.4, 225.2, 317, 339, 214, 205.3, 311.2; 211/57.1, 59.1, 113, 86; 40/11 R, 10 R

[56] References Cited

U.S. PATENT DOCUMENTS

| | | | |
|---|---|---|---|
| D. 193,919 | 10/1962 | Meyers et al. | 211/113 |
| 2,264,957 | 12/1941 | Shafarman | 211/113 |
| 2,628,054 | 2/1953 | Fazakerley | 248/311.2 |
| 3,913,876 | 10/1975 | McSherry | 248/205.3 |
| 4,106,741 | 8/1978 | Hogg | 248/467 |
| 4,217,986 | 8/1980 | Brown | 211/57.1 |
| 4,239,167 | 12/1980 | Lane | 248/205.3 |
| 4,380,324 | 4/1983 | Woesler | 248/317 |
| 4,417,710 | 11/1983 | Adair | 248/205.3 |

*Primary Examiner*—Ramon S. Britts
*Assistant Examiner*—Ramon O. Ramirez
*Attorney, Agent, or Firm*—Holman & Stern

[57] ABSTRACT

An integral unit for suspending one or more apertured items for display forwardly of a display shelf is arranged to be secured to the shelf and, alternatively, to a hook which is secured to the shelf. The unit is an integral flexible plastic strip and includes a mounting portion which joins an item-supporting portion at a transversely extending fold line. The upper edge of the mounting portion includes an anchor adapted to be resiliently inserted and interlock in a hole in a display shelf so as to engage the shelf for purposes of mounting. A through hole in the mounting portion permits the strip to be suspended from a hook. One side of the mounting portion may be adhesively coated for a further alternative manner of securing the strip to the shelf. The item-supporting portion has one or more finger-like hook members defined by inverted U-shaped die-cuts in the strip. The finger-like hook members are vertically aligned to support the apertured items for display.

16 Claims, 4 Drawing Figures

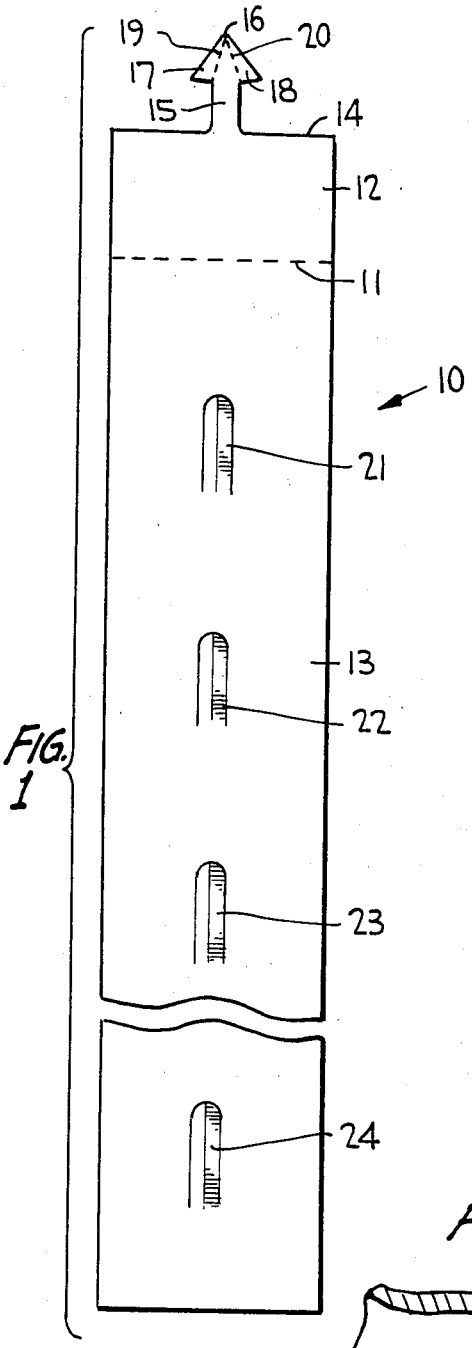
FIG. 1
FIG. 2
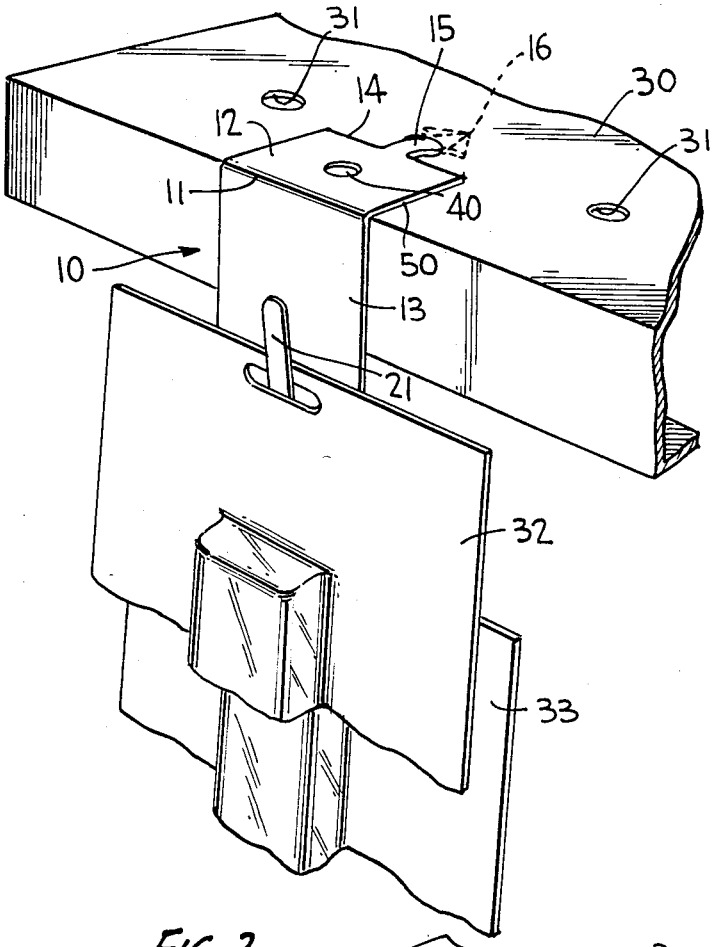
FIG. 3
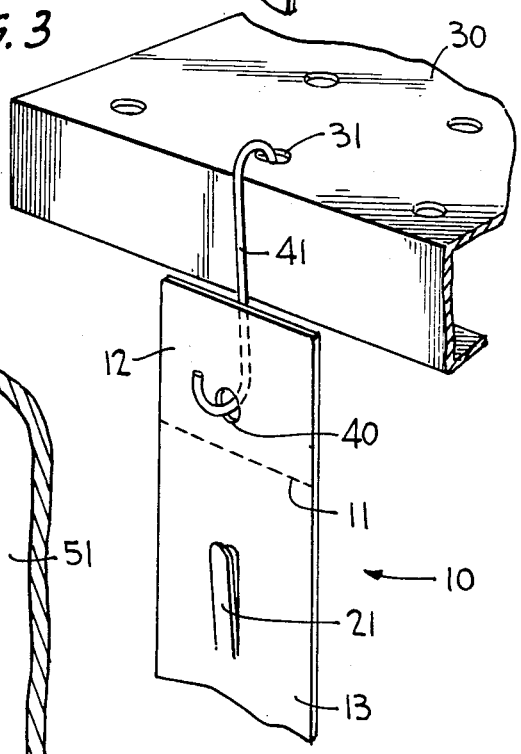
FIG. 4
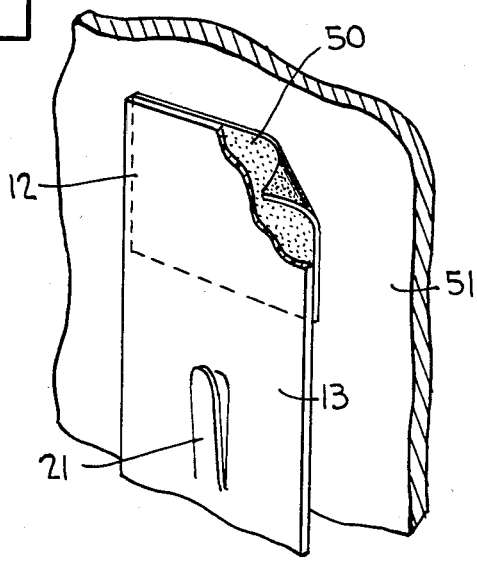

STRIP MERCHANDISER

CROSS REFERENCE TO RELATED APPLICATIONS

The present application is a continuation-in-part of my prior copending U.S. Patent application Ser. No. 06/422,009, filed Sept. 23, 1982, entitled "Improved Support Unit for Display Items", the subject matter of which is expressly incorporated herein in its entirety by reference.

BACKGROUND OF THE INVENTIONS

1. Technical Field

The present invention relates to articles of manufacture suitable for supporting apertured items for display. More particularly, the present invention relates to support members for displayed items, which members can be suspended forwardly of a display shelf. The displayed items generally take the form of blister packs, apertured sheets of promotional material, and the like, but are not so limited.

2. Discussion of the Prior Art

Apertured items such a blister packs, and the like, are generally suspended forwardly of a display shelf on which other items for display are supported. The apertured items may be suspended one-behind-the-other from a common hook-like member, such as the well known J-hook. The J-hook, although widely used, can be somewhat disadvantageous since it projects considerably forward of the shelf into an aisle traveled by shoppers. The projecting J-hook can thus cause injury or damage to the person or clothing of the shoppers.

An alternative to the J-hook is the clip-strip, such as described and illustrated in my U.S. Patent application Ser. No. 06/358,868, filed Mar. 17, 1982, and entitled "Support Hook and Assembly for Merchandising Display" (the disclosure of which is expressly incorporated herein by this reference in its entirety). The clip-strip is suspended from the forward edge of a display shelf and supports items for display one above the other. This arrangement greatly reduces the danger to passing shoppers. However, the clip-strip requires a separate structure in order to attach it to the display shelf, thereby increasing its costs.

In my afore-mentioned U.S. Patent application Ser. No. 06/422,009, I disclosed a unit for supporting apertured items, such as blister packs, which unit is adapted to be supported on a lower ledge of a price molding or similar forward facing edge of a display shelf. Specifically, that unit includes a flexible tag-like mounting portion having a bottom support edge divided into two longitudinally-spaced and alignable edge segments. The edge segments are adapted to rest on a lower ledge formed in the forward edge of a display shelf. If the shelf forward ledge is a price molding, the tag-like mounting portion is flexed about an axis disposed parallel to the edge segments so that the upper edge of the mounting portion engages the upper ledge of the price molding and the mounting portion is secured by flexible engagement to the price molding. Alternatively, the back of the mounting portion may be provided with an adhesive backing to hold the mounting portion in place with the edge segments resting on the lower shelf ledge.

The support unit of my aforesaid patent application further includes an integral item-supporting portion in the form of a strip or flap member which extends through the space between the edge segments of the mounting portion. The flap includes one or more finger-like support hooks which are die cut so as to be bent or flexed out of the plane of the flap or strip so that one or more apertured items may be suspended from the hooks. In one embodiment, the hooks are arranged one-above-the-other and are contoured arcuately in a dimension transverse to their lengths to impart strength thereto. In another embodiment, the hook has a bi-winged tip which is flexibly foldable to permit it to be inserted into an aperture of a display item. The wings resiliently unfold to lock the item onto the hook. This latter arrangement is suitable for promotional paper sheets which can be placed on the hook in stacks and then individually torn off the hook by shoppers.

Although the support unit described in my aforementioned U.S. Patent application Ser. No. 06/422,009 is quite effective for displaying merchandise forwardly of a shelf, it is only applicable to display shelves which have a bottom ledge on their forward facing edges. For shelves having no such ledge, the support unit cannot be properly mounted without adhesive, or the like.

OBJECTS AND SUMMARY OF THE INVENTION

It is therefore an object of the present invention to provide a unit for supporting apertured items, such as blister packs, promotional material, etc., forwardly of a display shelf without projecting dangerously far in front of the shelf, and without requiring the shelf to include a ledge on its forward edge for supporting the unit.

It is another object of the present invention to provide a unit for supporting items for display by suspending the items from a display shelf, which unit is simple and inexpensive to manufacture, but is simply and quickly deployed.

It is still another object of the present invention to provide an integrally formed flexible plastic member which can readily be supported on a display shelf even if that shelf does not have a ledge on its forward-facing edge, and which can itself support one or more apertured items immediately forward of the shelf.

Still another object of the present invention is to provide an integrally formed flexible plastic member which supports apertured items for display and which can be secured to a display shelf in alternative manners such as interlock engagement with the shelf via holes in the shelf, adhesive attachment to the shelf, or by an intermediate hook which engages both the shelf and the unit.

In accordance with the present invention, a merchandise support unit is constructed as an integrally formed elongated plastic strip subdivided into a mounting portion and an article-supporting portion by a transversely-extending fold line. The mounting portion is a generally rectangular flap having an anchor extending from its upper edge remote from the fold line. The anchor includes a proximal end integrally joined to the upper edge of the flap, a distal anchor end, and an intermediate portion. The anchor end may take the form of an arrowhead pointing away from the mounting flap with the wings of the arrowhead spaced more widely than the width of the intermediate portion and more widely than the diameter or other dimension of a standard hole or aperture defined in merchandise display shelves. Anchor fold lines are defined in the arrowhead to permit the wings to be resiliently folded out of plane and inserted into the hole in the display shelf. Once thusly inserted, the wings are released and unflexed and engage the bottom of the shelf to prevent inadvertent withdrawal of the anchor from the shelf hole. Alternatively, the arrowhead may be eliminated in which case the anchor takes the form of a tab which is frictionally engaged in the shelf hole. The strip may be folded on the transverse fold line so that the mounting flap resides horizontally along the top surface of the display shelf, and so that the item-supporting portion is suspended forwardly of the shelf.

The mounting flap is also provided with an aperture to permit alternative mounting without folding from a hook which is adapted to engage a display shelf hole. The shelf-facing side of the mounting flap may be coated with adhesive to provide a still further mounting alternative which is particularly adaptable for use with display shelves having no holes.

The item-supporting portion of the strip may take any of the forms described and illustrated in my afore-mentioned U.S. Patent application Ser. No. 06/422,009.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings wherein similar elements in the various figures are designated by the same reference numerals, and wherein:

FIG. 1 is a broken view in plan of a merchandise support strip constructed in accordance with the principles of the present invention;

FIG. 2 is a view in perspective of the strip of FIG. 1 shown secured to a display shelf and supporting apertured items for display;

FIG. 3 is a view in perspective showing the support strip of FIG. 1 with an alternative mounting arrangement with respect to a display shelf; and FIG. 4 is a view in perspective of the strip of FIG. 1 showing a further alternative mounting arrangement with respect to a display shelf.

DESCRIPTION OF THE PREFERRED EMBODIMENTS

Referring specifically to FIG. 1 of the accompanying drawings, a support member for display items includes an integrally formed elongated plastic strip having various die-cuts and fold lines defined therein. A transversely extending fold line 11 is provided proximate the upper end of the strip to subdivide the strip into a mounting portion 12 and an item-supporting portion 13. The mounting portion 12, which is considerably smaller in length than the item-supporting portion, is generally rectangular with an upper edge 14 disposed remotely opposite the fold line 11. An anchor member projects from upper edge 14 away from the fold line 11 and includes a stem portion 15 and a distal end 16 in the form of an arrowhead. The wings 17 and 18 of the arrowhead 16 extend transversely beyond the sides of stem portion 15 and are defined by fold lines 19 and 20 which extend from the distal apex of the arrowhead to the termination of the sides of stem portion 15. Fold lines 19 and 20 permit the wings 17 and 18, respectively, to be folded out of plane with respect to stem portion 15 and the remainder of the arrowhead. The plastic material utilized for the strip is preferrably sufficiently resilient to permit the wings 17, 18 to return to their unfolded position, or substantially unfolded position, after being folded and then released. Fold line 11, on the other hand, is intended to permit the mounting portion 12 to be maintained in a substantially perpendicular orientation with respect to the item-supporting portion 13.

The item-supporting portion 13 is provided with a plurality of longitudinally spaced and aligned inverted U-shaped die-cuts which define respective support hooks or fingers 21,22,23,24, etc. The fingers or hooks 21–24 may be flexed out-of-plane with respect to the item-supporting portion 13 of the strip so that the distal ends of the fingers 21–24 are spaced from the strip. In this manner, an apertured item may be suspended from each finger 21–24.

The strip of FIG. 1 is shown deployed in one possible mounting arrangement in FIG. 2, to which specific reference is now made. Specifically, the strip 10 is shown secured to the top or horizontal surface of a merchandise display shelf 30. Shelf 30 is provided with a plurality of holes 31 defined through the top surface thereof. The holes 31 are illustrated as being of circular configuration, although it is to be understood that other shaped holes, such as diamond-shaped, square-shaped, etc., are also used in such shelves and are equally applicable for utilization with the present invention. The strip 10 is secured to shelf 30 by folding the wings 17 and 18 along respective fold lines 19 and 20 so that the anchor 16 may be inserted into one of the holes 31 which is disposed near the forward edge of the shelf. Once the resilient anchor has been inserted into the hole, the wings are spread once again to engage the underside of the shelf and prevent inadvertent removal of the anchor through the hole 31. The strip 10 may then be folded along transverse fold line 11 so that the fold line resides at or forwardly of the forward edge of the shelf. The fold which is made along fold line 11 is at a right angle so that the item-supporting portion 13 of the strip is suspended downwardly in front of the shelf. Individual apertured display items 32, 33, etc. are then placed on the support fingers 21, etc., one-above-the-other, so that the items are suspended and displayed forwardly of shelf 30.

As illustrated in FIG. 2, the mounting portion 12 may be provided with a through hole 40 which serves as an alternative mounting arrangement. Specifically, this alternative mounting arrangement is illustrated in greater detail in FIG. 3 wherein a generally S-shaped support hook has one end inserted in a hole 31 of a merchandise display shelf 30 such that the opposite end of the hook 41 is suspended forwardly of the shelf. The opposite end of hook 41 is inserted through the mounting hole 40 defined in the mounting portion 12 of the strip. For purposes of preserving clarity of the illustration of this mounting arrangement, the anchor 16 and stem 15 have been omitted from the drawing of FIG. 3. In this mounting arrangement the strip 10 is not necessarily folded along transverse fold line 11 but instead may be suspended as shown in FIG. 3.

A further alternative mounting arrangement for strip 10 involves adhesively coating the underside of the mounting portion 12 so that the mounting portion may be secured to shelves which do not include mounting holes 31. For example, the underside of mounting portion 12 as illustrated in FIG. 2 may be adhesively coated at 50 to thereby illiminate the need for inserting the anchor 16 into a mounting hole 31. Alternatively, the adhesive coating 50 may be employed to permit the mounting portion 12 to be secured to a vertically-extending surface 51 in the manner illustrated in FIG. 4. It should be noted that, for purposes of illustrative clarity, the anchor 16 is not illustrated in the embodiment illustrated in FIG. 4.

The merchandise support strip described and illustrated herein has the flexibility of three alternative mounting arrangements, namely: (1) interlocking the strip to a support hole in a shelf by means of anchor 16; (2) suspending the strip from a shelf by means of a hook 41 inserted through mounting hole 40; and (3) adhesively securing the mounting portion to a horizontal or vertical surface of a shelf or other support structure. The item-supporting portion 13 may be configured in the manner illustrated herein or in the manner illustrated and described in my afore-mentioned U.S. Patent application Ser. No. 06/422,009.

The particular configuration of the anchor 16 as illustrated and described herein is not to be construed as limiting the scope of the present invention. Specifically, the anchor need not be configured as an arrowhead but instead may have any general configuration which is larger than the mounting holes 30 in a support shelf but which can be squeezed to permit insertion into such support holes for subsequent anchoring or frictional engagement therein. In this regard, the wings 17 and 18, although providing an advantageous anchoring function by engaging the underside of the display shelf, may be dispensed with, in which case the frictional engagement of the anchor member in mounting hole 31 would supply the necessary mounting for the strip. Thus, even a rounded edge of stem 15, without the arrowhead, may be inserted into the mounting hole 31 by flexing the stem 15 lengthwise; upon release of the flexure force, the sides of the stem engage the holes 31 and prevent inadvertent withdrawal of the anchor member therefrom.

While I have described and illustrated various specific embodiments of my invention, it will be clear that variations from the details of construction which are specifically illustrated and described may resorted to without departing from the true spirit and scope of the invention as defined in the appended claims.

What is claimed is:

1. An article of manufacture for suspending apertured items forwardly of a display shelf, said article of manufacture comprising an integrally formed elongated plastic strip subdivided into a mounting portion and an item-supporting portion by a transversely-extending fold line extending entirely across the width of the strip to permit said mounting portion to be disposed horizontally on the display shelf and said item-supporting portion to be suspended vertically forwardly of the display shelf, said mounting portion having an upper edge remote from said fold line with an anchor member extending therefrom, said anchor member including a stem portion terminating in a transversely widened anchor portion, and wherein said item-supporting portion includes at least one finger-like member with a proximal end secured to said strip and a remote end which can be projected forwardly of said strip by bending said finger-like member at said proximal end.

2. The article of manufacture according to claim 1 wherein said anchor member includes at least one anchor fold line for permitting the anchor to be resiliently folded and inserted into a hole in said display shelf, wherein said anchor member is transversely wider than the hole in said display shelf so as to engage the display shelf at said hole.

3. The article of manufacture according to claim 2 wherein said mounting portion includes a through hole to permit said strip to be suspended from a hook inserted through said through hole.

4. The article of manufacture according to claim 3 wherein said mounting portion is coated on at least one surface with adhesive means for securing said strip to the display shelf.

5. The article of manufacture according to claim 4 further comprising a plurality of said finger-like members arranged in vertically spaced linear alignment, all of said finger-like members being bendable forwardly of said strip to support apertured items for display.

6. The article of manufacture according to claim 5 wherein said finger-like members are defined by respective inverted U-shaped die-cuts in said strip.

7. The article of manufacture according to claim 3 wherein said item-supporting portion includes a plurality of said finger-like members arranged in vertically spaced linear alignment all of said finger-like members being bendable forwardly of said strip to support apertured items for display.

8. The article of manufacture according to claim 7 wherein said finger-like members are defined by respective inverted U-shaped die-cuts in said strip.

9. The article of manufacture according to claim 2 further comprising a plurality of said finger-like members arranged in vertically spaced linear alignment, all of said finger-like members being bendable forwardly of said strip to support apertured items for display.

10. The article of manufacture according to claim 9 wherein said finger-like members are defined by respective inverted U-shaped die-cuts in said strip.

11. The article of manufacture according to claim 2 wherein said mounting portion is coated on at least one surface with adhesive means for securing said strip to the display shelf.

12. The article of manufacture according to claim 11 further comprising a plurality of said finger-like members arranged in vertically spaced linear alignment, all of said finger-like members being bendable forwardly of said strip to support apertured items for display.

13. The article of manufacture according to claim 12 wherein said finger-like members are defined by respective inverted U-shaped die-cuts in said strip.

14. An article of manufacture for suspending apertured items forwardly of a display shelf, said article of manufacture comprising an integrally formed elongated plastic strip subdivided into a mounting portion and an item-supporting portion by a transversely-extending fold line extending entirely across the width of the strip to permit said mounting portion to be disposed horizontally on the display shelf and said item-supporting portion to be suspended vertically forwardly of the display shelf, said mounting portion having a through hole to permit said strip to be suspended from a hook mounted through said through hole, and wherein said mounting portion is coated on at least one surface with adhesive means for securing said strip to the display shelf, and wherein said item-supporting portion includes at least one finger-like member with a proximal end secured to said strip and a remote end which can be projected forwardly of said strip by bending said finger-like member at said proximal end.

15. The article of manufacture according to claim 17 further comprising a plurality of said finger-like members arranged in vertically spaced linear alignment, all of said finger-like members being bendable forwardly of said strip to support apertured items for display.

16. The article of manufacture according to claim 15 wherein said finger-like members are defined by respective inverted U-shaped die-cuts in said strip.

* * * * *